US007086612B2

(12) United States Patent
Crawford

(10) Patent No.: US 7,086,612 B2
(45) Date of Patent: Aug. 8, 2006

(54) FOAMING MACHINE

(75) Inventor: Gary Crawford, 2100 196th St., SW., #138, Lynnwood, WA (US) 98036

(73) Assignee: Gary Crawford, Lynnwood, WA (US)

( * ) Notice: Subject to any disclaimer, the term of this patent is extended or adjusted under 35 U.S.C. 154(b) by 0 days.

(21) Appl. No.: 10/622,750

(22) Filed: Jul. 18, 2003

(65) Prior Publication Data

US 2004/0016829 A1 Jan. 29, 2004

Related U.S. Application Data

(60) Provisional application No. 60/397,237, filed on Jul. 18, 2002.

(51) Int. Cl.

| | |
|---|---|
| ***F23D 11/10*** | (2006.01) |
| ***F23D 11/40*** | (2006.01) |
| ***F23D 14/62*** | (2006.01) |
| ***A62C 5/02*** | (2006.01) |
| *A63H 33/28* | (2006.01) |
| *A63H 33/30* | (2006.01) |

(52) U.S. Cl. ..... 239/418; 239/8; 239/10; 446/15; 446/16; 446/17; 446/18; 446/20; 446/21; 446/22; 446/475

(58) Field of Classification Search ..... 446/15–21, 446/176, 180, 186, 197, 267, 475; 239/418; 261/DIG. 26; 56/371, 229

See application file for complete search history.

(56) References Cited

U.S. PATENT DOCUMENTS

| | | | | |
|---|---|---|---|---|
| 3,402,771 | A * | 9/1968 | Frey | 169/15 |
| 4,531,588 | A * | 7/1985 | Brunsicke | 169/9 |
| 4,598,536 | A * | 7/1986 | Langley | 56/202 |
| 4,653,591 | A * | 3/1987 | Marshall | 169/15 |
| 5,033,258 | A * | 7/1991 | Morse | 56/2 |

* cited by examiner

*Primary Examiner*—David A. Scherbel
*Assistant Examiner*—James S. Hogan
(74) *Attorney, Agent, or Firm*—Black Lowe & Graham PLLC

(57) ABSTRACT

The present invention provides an assembly, sock, and method for generating foam. The assembly includes a housing having a chamber, and a first and second orifice. A fan arranged within the housing draws a flow of air into the chamber through the first orifice and exhausts the flow of air through the second orifice to form an exhausted flow of air. A nozzle is arranged within the chamber and is situated in proximity to the second orifice to allow introduction of a fluid into the exhausted flow of air through the second orifice. A permeable sock includes an inner surface and an outer surface. The sock is arranged to occlude the second orifice in a manner to receive the exhausted flow of air with the fluid at the inner surface.

12 Claims, 2 Drawing Sheets

FOAMING MACHINE

RELATED APPLICATIONS

This application claims priority from the provisional application Ser. No. 60/397,237 filed on Jul. 18, 2002. The provisional application is hereby incorporated by this reference.

BACKGROUND OF THE INVENTION

For the past several years, industrial fires have been fought using a variety of surfactant foams. A foam generator comprised of a specialized nozzle for entraining air and surfactants into a stream of water, was used to create the fire fighting foam. Such a foam generator would both generate and propel foam for fighting industrial fires.

The foam generator was introduced in Europe for use in nightclubs and in stage productions, and is being advantageously used in entertainment settings for theatrical effect. The foam generator of the present invention is similar to currently available fire fighting foam generators, but the surfactants used in this presently preferred embodiment are altered to make the product more suitable for ease in dispersing and cleaning up after use.

However, creating foam in stage production environments does require the foam generator to disperse large amounts of water to entrain the air and surfactants. The problem presented herein is that a large amount of water remains after the theatrical effect is completed. The dispersed water could harm environments where the foam generator is used. For example, floors and ceilings might suffer damage from the abundance of the remaining water. This damage would likely cause users to stop using the currently available foam.

Therefore, there is currently an unmet need in the art for a foam generator that would generate great amounts of foam while using much less water than currently available foam generators.

SUMMARY OF THE INVENTION

The present invention provides an assembly, sock, and method for generating foam. The assembly includes a housing having a chamber, and a first and second orifice. A fan arranged within the housing draws a flow of air into the chamber through the first orifice and exhausts the flow of air through the second orifice to form an exhausted flow of air. A nozzle is arranged within the chamber and is situated in proximity to the second orifice to allow introduction of a fluid into the exhausted flow of air through the second orifice. A permeable sock includes an inner surface and an outer surface. The sock is arranged to occlude the second orifice in a manner to receive the exhausted flow of air with the fluid at the inner surface.

The sock is selected for its permeability to optimize the relationship between the volume of foam generated and the amount of fluid necessary to generate the foam, such that the smallest amount of fluid generates the greatest volume of foam.

Because the assembly allows the generation of the flow of air to occur remotely from the sock, the configuration of the assembly can be further optimized to ensure that the noise primarily remains at the sock, where the foam is generated. This quality of the present invention allows use of the foam for theatrical effect with a minimal amount of distraction from the theatrical event the effect is to enhance.

BRIEF DESCRIPTION OF THE DRAWINGS

The preferred and alternative embodiments of the present invention are described in detail below with reference to the following drawings.

DETAILED DESCRIPTION OF THE PREFERRED EMBODIMENT

By way of overview, the present invention provides an assembly, sock, and method for generating foam. The assembly includes a housing having a chamber, and a first and second orifice. A fan arranged within the housing draws a flow of air into the chamber through the first orifice and exhausts the flow of air through the second orifice to form an exhausted flow of air. A nozzle is arranged within the chamber and is situated in proximity to the second orifice to allow introduction of a fluid into the exhausted flow of air through the second orifice. A permeable sock includes an inner surface and an outer surface. The sock is arranged to occlude the second orifice in a manner to receive the exhausted flow of air with the fluid at the inner surface.

Figure 1:
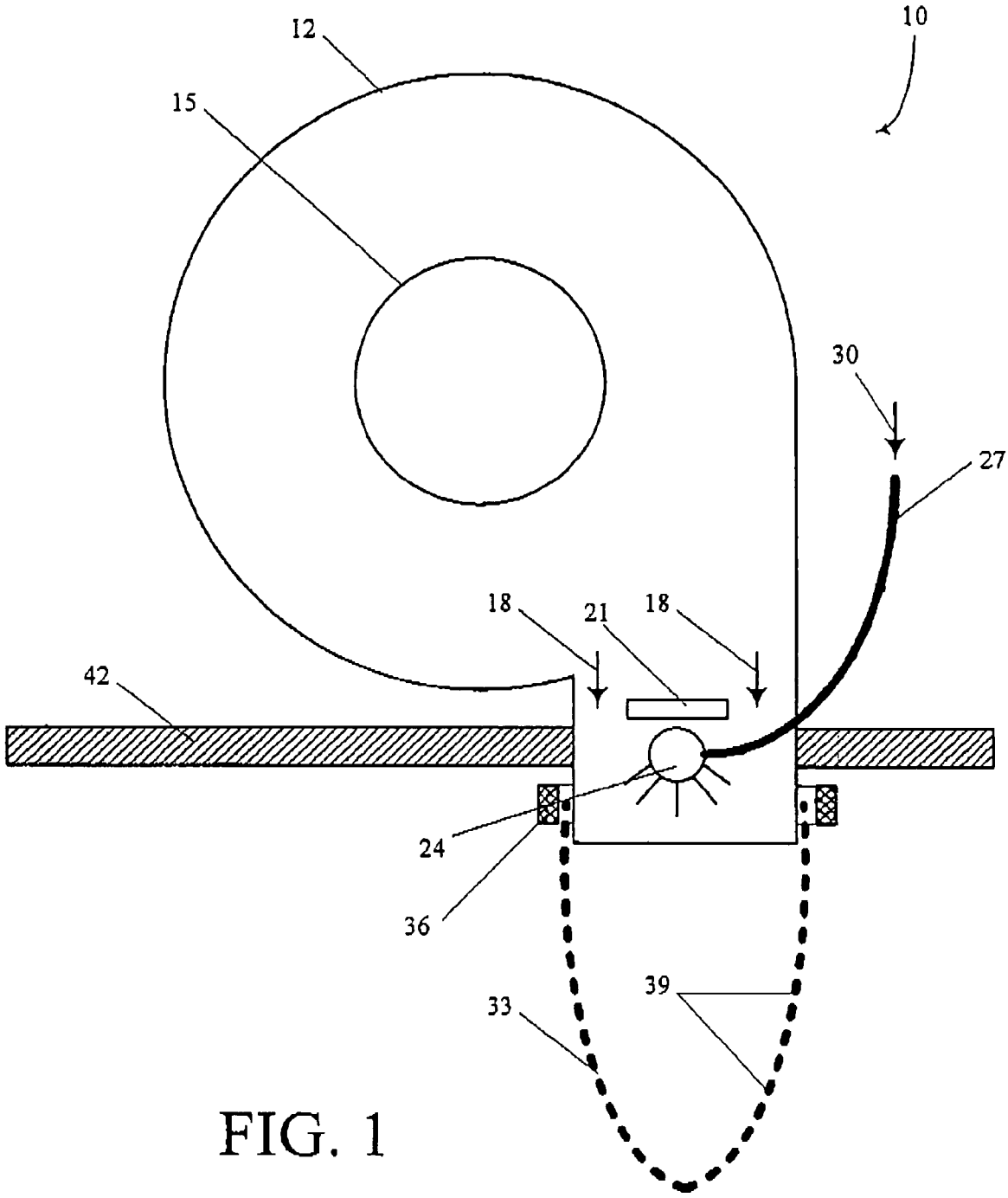
FIG. 1 is a cut-away view of the foam generating assembly.

FIG. 1 depicts a cut-away view of a foam generating machine 10. A housing 12 defines a chamber. In conjunction with the fan 15, the housing 12 motivates a flow of air 18. Any of several blower mechanisms will work to motivate the air to form and to direct the flow of air 18, however, for purposes of illustrating the present invention, a squirrel-cage blower is shown. The minimum configuration necessary is for the flow of air 18 to be generated within the housing 12. For example, where suitably pressurized air is provided, the configuration might only comprise the housing 12 for receiving pressurized air in order to create the flow of air 18 within the housing 12. In the presently preferred and illustrated embodiment, the fan 15 is turned by an electric motor (not shown) drawing air through a first orifice (not shown) to generate the flow of air 18 within the housing 12.

At the point of the flow of air 18, a nozzle 24 atomizes a fluid 30 into the airflow 18. An air dam 21 interrupts the flow of air 18 in the vicinity of the nozzle 24 in order to optimize the atomization of the fluid 30 at the locus of the flow of air 18 within the housing 12. To supply the nozzle 24 with fluid 30, a supply line 27 is provided. In one presently preferred embodiment, the fluid 30 is fed through the supply line 27 by a motorized pump (not shown) drawing fluid 30 from a tank (not shown). The presently preferred embodiment includes a switching network (not shown) to simultaneously power the motor (not shown) turning the fan 15 and the motorized pump.

Foam is generated by passing the atomized fluid 30 into the flow of air 18 through a permeable sock 33 that is detachably affixed to the housing 12 by a clamp 36 or other clamping mechanism. The sock 33 provides a medium to hold the atomized fluid 30 against the flow of air 18 in order to create a volume of bubbles. The volume of bubbles is known as foam. The permeability of the sock 33 is a function of the presence of a plurality of apertures 39.

In another embodiment, the sock 33 is formed by a woven textile fabric, as in the presently preferred embodiment, the apertures 39 are defined by the warp and woof of the textile fabric. The size of the aperture 39, the spced of the fan 15, and the pressure and quality of the fluid 30 determine the size and texture of the formed bubbles.

The presently preferred embodiment utilizes a woven textile fabric that is an olefin such as is commonly used in the material used for lawn-mower bags, having open weave defining apertures on a magnitude of approximately $1/16^{th}$ of an inch.

The flow of air 18 past the nozzle 24 entrains the atomized fluid 30 to create a mixture of air and fluid 30 that is distributed over an inner surface of the sock 33. The fluid 30 may be any suitable surfactant solution such as Foam Dome™ fluid and coats the inner surface of the sock 33. As the flow of air 18 produces an air pressure differential between the inner and outer surfaces of the sock 33, the flow of air 18 continues through the apertures 39 to form bubbles. These bubbles are collectively known as the foam.

The foam continues to generate to form a continuous material. As more and more foam continues to form, it occupies a larger and larger volume. The foam tends to expand outwardly from the socket 33. The shield 42 keeps foam from entering an air intake of the fan 15. The shield 42 is preferably made from a lightweight material to facilitate the portability of the foam machine 10. In another presently preferred embodiment, the shield may form a conduit such as a pipe, providing foam distribution in a current of air to carry the foam away from the foam generating machine 10.

As will readily be appreciated by those skilled in the art, the foam generating machine 10 may be hung by its housing 12 to allow walking passage underneath the unit without touching it. It may also be placed on a floor to distribute a carpet of foam. In still other presently preferred embodiments, the foam machine 10 may be fixedly attached to a second machine configured to provide a current of air to distribute the foam.

Figure 2:
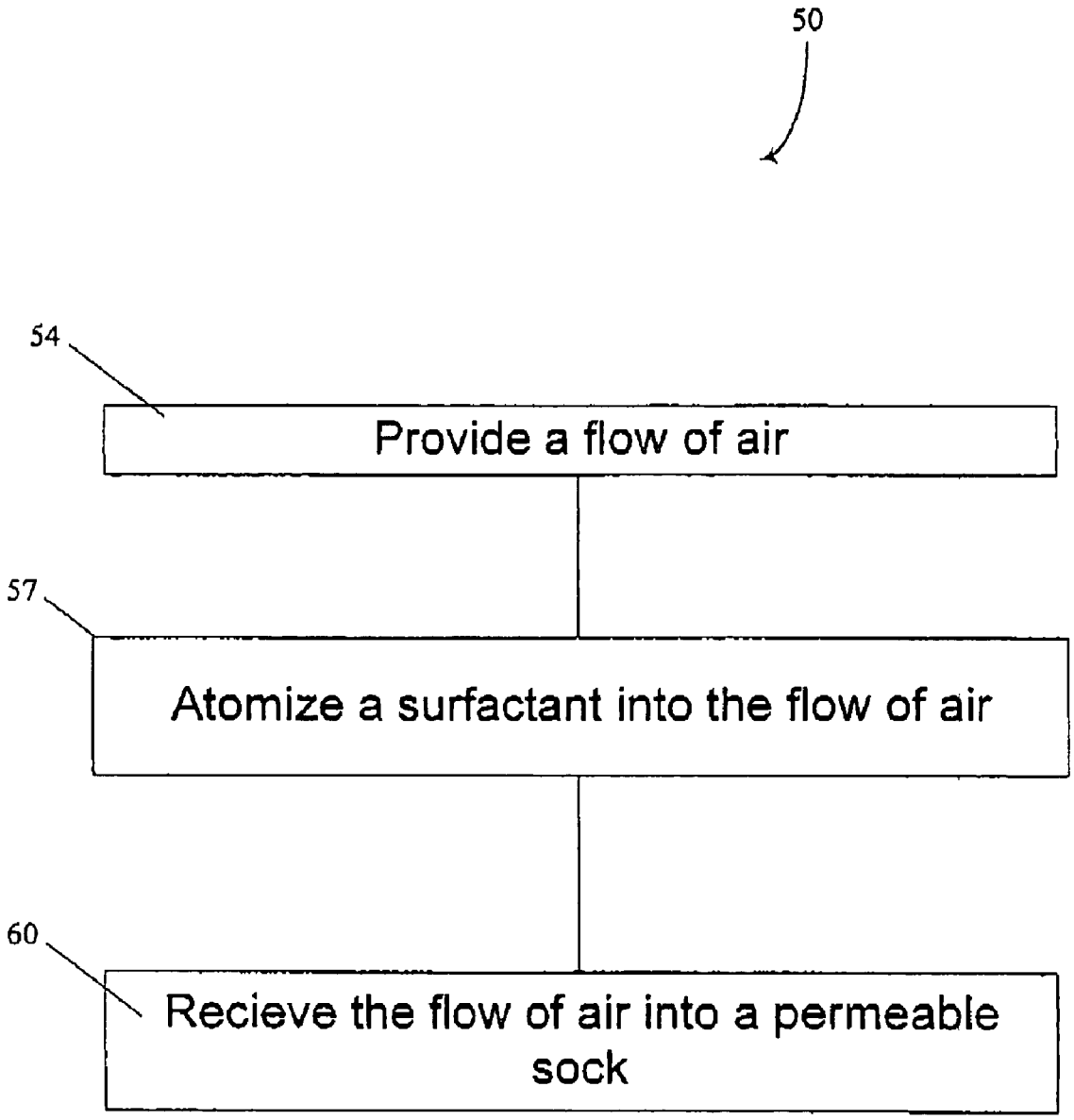
FIG. 2 is a flow chart of the method for generating the foam.

Referring to FIG. 2, a flow chart illustrates a method 50 for the generation of foam. The method 50 includes generating a flow of air 18 at a block 54. This flow of air 18 is generated in a suitable volume at a suitable pressure to optimize the production of foam according to the permeability of the sock 33 (FIG. 1). Generally, the flow of air 18 will be contained by a housing 12, although the housing 12 is not necessary for containing the flow of air 18. Foam is generated much as bubbles are generated, by directing the flow of air 18 and surfactant fluid 30 through an aperture 39.

A surfactant fluid 30 is atomized into the flow of air 18 at a block 57. Again, as will be readily appreciated by those skilled in the art, the ratio between the volume of the flow of air 18 and the atomized surfactant fluid 30 may be changed according to the desired results. At a block 60, the flow of air 18 and the atomized surfactant fluid 30 are received in a permeable sock 33. The surfactant fluid 30 flows over the inner surface of the permeable sock 33. The flow of air 18 generates bubbles, forming a generated foam.

While the preferred embodiment of the invention has been illustrated and described, as noted above, many changes can be made without departing from the spirit and scope of the invention. For example, the blower may be located remotely from the nozzle and the sock, allowing the foam to be generated at a site remote from the generation of the flow of air 18. Accordingly, the scope of the invention is not limited by the disclosure of the preferred embodiment. Instead, the invention should be determined entirely by reference to the claims the follow.

The embodiments of the invention in which an exclusive property or privilege is claimed are defined as follows:

1. An assembly for generating foam, the assembly comprising:

a housing defining a chamber with a first orifice and a second orifice;

a fan arranged within the housing to draw a flow of air into the chamber through the first orifice and to exhaust the flow of air through the second orifice to form an exhausted flow of air;

a nozzle arranged within the chamber and situated in proximity to the second orifice to allow introduction of a fluid into the exhausted flow of air through the second orifice; and a sock, the sock including a permeable felt textile, the felt textile having an inner surface and an outer surface, and being arranged to occlude the second orifice in a manner to receive the exhausted flow of air with the fluid at the inner surface.

2. The assembly of claim 1, further comprising a dam arranged within the chamber to influence the exhausted flow of air in a manner to enhance the introduction of the fluid.

3. The assembly of claim 1, wherein the fan is a squirrel cage blower.

4. The assembly of claim 1, wherein the fluid is a surfactant, such that the exhausted flow of air is received into the sock to generate a foam at the outer surface.

5. The assembly of claim 1, wherein the housing includes a shield being arranged to prevent the generated foam from flowing into the first orifice.

6. An assembly for generating foam, the assembly comprising:

a housing defining a chamber with a first orifice and a second orifice, the housing configured to include a shield being arranged to prevent generated foam from flowing into the first orifice;

a fan arranged within the housing to draw a flow of air into the chamber through the first orifice and to exhaust the flow of air through the second orifice to form an exhausted flow of air;

a nozzle arranged within the chamber and situated in proximity to the second orifice to allow introduction of a fluid into the exhausted flow of air through the second orifice; and a sock, the sock being permeable, having an inner surface and an outer surface, and being arranged to occlude the second orifice in a manner to receive the exhausted flow of air with the fluid at the inner surface.

7. The assembly of claim 6, further comprising a dam arranged within the chamber to influence the exhausted flow of air in a manner to enhance the introduction of the fluid.

8. The assembly of claim 6, wherein the fan is a squirrel cage blower.

9. The assembly of claim 6, wherein the fluid is a surfactant, such that the exhausted flow of air is received into the sock to generate a foam at the outer surface.

10. The assembly of claim 6, wherein the sock includes a fabric.

11. The assembly of claim 10, wherein the fabric is a woven textile.

12. The assembly of claim 10, wherein the fabric is a felt textile.

* * * * *